US005151170A

United States Patent [19]

Montgomery et al.

[11] Patent Number: 5,151,170

[45] Date of Patent: Sep. 29, 1992

[54] ACID COPPER ELECTROPLATING BATH CONTAINING BRIGHTENING ADDITIVE

[75] Inventors: Eda R. Montgomery; Randal D. King, both of Wilmington, Del.

[73] Assignee: McGean-Rohco, Inc., Cleveland, Ohio

[21] Appl. No.: 810,190

[22] Filed: Dec. 19, 1991

[51] Int. Cl.[5] ..... C25D 3/38

[52] U.S. Cl. ..... 205/298; 205/296; 205/297

[58] Field of Search ..... 205/296, 297, 298

[56] References Cited

U.S. PATENT DOCUMENTS

| | | | |
|---|---|---|---|
| 3,359,297 | 12/1967 | Gändel | 205/296 |
| 3,502,551 | 3/1970 | Todt et al. | 205/296 |
| 4,667,049 | 5/1987 | Heikkila et al. | 205/296 |
| 4,948,474 | 8/1990 | Miljkovic | 205/297 |

*Primary Examiner*—John Niebling

*Assistant Examiner*—Brian M. Bolam

*Attorney, Agent, or Firm*—William P. Hauser; James A. Lucas

[57] ABSTRACT

For acid copper plating baths containing a brightener used to produce smooth copper coatings of high brilliancy, it has been found that the "break-in" period normally needed after a brightener is added to the plating bath, has been virtually eliminated by use of the brightener of this invention. This brightener consists essentially of a peroxide oxidation product of a dialkylamino-thioxomethyl-thioalkanesulfonic acid wherein each alkyl and alkane group individually contains 1 to 6 carbon atoms and wherein the peroxide oxidation of the dialkylamino-thioxomethyl-thioalkane-sulfonic acid is carried out in an acid, aqueous medium having a pH of not more than about 1. In an added embodiment of this invention the acid copper plating bath also contains hydrolysis products of the peroxide oxidation product of a dialkylamino-thioxomethyl-thioalkanesulfonic acid.

15 Claims, No Drawings

ACID COPPER ELECTROPLATING BATH CONTAINING BRIGHTENING ADDITIVE

BACKGROUND OF THE INVENTION

The invention relates to brightening additives for use in acid copper electroplating baths and particularly in such baths as used to manufacture printed circuit boards for the electronics industry. More particularly, the invention relates to such brightening additives prepared from dialkylamino-thioxomethyl-thioalkane-sulfonates and the like.

Dialkylamino-thioxomethyl-thioalkanesulfonate compositions have been used for many years in methods for the electrodeposition of metal. During the electrodeposition of metal deposits in the absence of organic brightener and leveler additives, metal deposits often form with a crystalline, matte or burned finish, can vary substantially in thickness from place to place on the deposit, can have pinholes, can have poor elongation properties, and can be low in tensile strength. Such a metal plate can be undesirable from an aesthetic point of view, and can be undesirable in many technological end uses. One major end use of the metal deposit is on a copper plated printed circuit board. The copper deposit on a circuit board should be bright, shiny, lustrous, uniform in thickness, have substantial elongation properties, and modest tensile strength. Bright, shiny boards are easily wetted by solder compositions providing for rapid and efficient connection of electrical components to the printed circuit board. Uniform continuous coatings of copper that have acceptable elongation properties and tensile strength can be resistant to the formation of hairline cracks, which can form during the manufacture and use of the electronic device, that can result in the interruption of the electrical current and in the failure of the electronic device to operate.

A significant industry effort has addressed the need for the preparation of dialkylamino-thioxomethyl-thioalkanesulfonate brightener compositions of high purity at high yield substantially free of inactive or harmful by-products and avoids generating substantial quantities of nonvolatile impurities which can interfere in electroplating. Notable in the industry effort is the method disclosed in U.S. Pat. No. 4,667,049 wherein an alkali metal dialkylamino-thioxomethyl-thioalkane-sulfonate composition is prepared by reacting a monoamine with carbon disulfide to form a dithiocarbamic acid monoamine salt, reacting the salt with an alkyl sultone to form a dialkylamino-thioxomethyl-thioalkane-sulfonate monoamine salt which is then reacted with an alkali metal base to form the alkali metal salt.

In the conventional electroplating process, including such processes for manufacture of printed circuits, a "break-in" period is needed after the brightener is added to the plating bath. During this period the brightening activity builds to a working steady-state level needed to produce bright plated metal. When brightening activity of a working plating bath declines, plating is interrupted to allow for "break-in" of freshly added brightener. Since such "break-in" periods typically range from several hours to several days, the efficiency or throughput of the plating operation is limited. There is a need in the plating industry, to substantially reduce or eliminate brightener "break-in" so as to improve the efficiency of plating operations.

SUMMARY OF THE INVENTION

It has been found that "break-in" has been virtually eliminated for copper plating baths of a type which is an acid copper plating bath for producing smooth copper coatings of high brilliancy containing at least one brightener consisting of a peroxide oxidation product of a dialkylamino-thioxomethyl-thioalkane-sulfonic acid wherein each alkyl and alkane group individually contains from 1 to 6 carbon atoms and wherein the peroxide oxidation of the dialkylamino-thioxomethyl-thioalkane-sulfonic acid is carried out in an acid, aqueous medium having a pH of not greater than about 1.

DETAILED DESCRIPTION OF THE INVENTION

The acid copper plating bath of this invention is used for producing smooth copper coatings of high brilliancy. The bath contains as its distinguishing feature a brightener, including the acid-plating-bath hydrolysis products of the brightener, consisting essentially of the hydrogen peroxide oxidation product of a dialkylamino-thioxomethyl-thioalkanesulfonic acid wherein each alkyl and alkane group individually contains 1 to 6 carbon atoms, e.g., dimethylamino-thioxomethyl-thio-1,3-propanesulfonic acid. The hydrogen peroxide oxidation of the dialkylamino-thioxomethyl-thioalkanesulfonic acid is carried out in an acid, aqueous medium having a pH of not more than about 1. For example, 0.33 mmoles of dialkylamino-thioxomethyl-thioalkane-sulfonic acid, or preferably its alkali metal sulfonate salt, is reacted at room temperature with 2 mmoles of hydrogen peroxide in about 3 molar aqueous hydrochloric acid solution. The peroxide oxidation product resulting from this process is believed to be a compound of the formula:

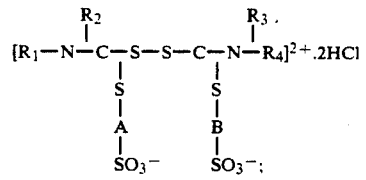

isomers thereof or mixtures thereof; wherein $R_1$, $R_2$, $R_3$ and $R_4$ each individually is an alkyl group having 1 to 6 carbon atoms, and wherein A and B each individually is an alkylene group having 1 to 6 carbon atoms. The acid copper plating baths of this invention are typically prepared by adding the peroxide oxidation product as the sole brightening additive to an otherwise conventional acid copper plating bath. After addition, such brighteners in the highly acid environment of the bath typically undergo hydrolysis to some extent. Consequently, for the purposes of this invention the term "peroxide oxidation product of a dialkylamino-thioxomethyl-thioalkanesulfonic acid" will also include the hydrolysis products thereof. The hydrolysis products in the acid copper plating baths of this invention are believed to include products selected from the group consisting of $R_5$—SH; $R_5$—SOH; $R_5$—$SO_2H$; $R_5SO_3H$; $R_5$—S—S—$R_6$; $R_5$—SO—S—$R_6$; and $R_5$—$SO_2$—S—$R_6$, wherein $R_5$ and $R_6$ are independently selected from the group consisting of $$-A-SO_3^-; \quad (1)$$

-continued $$-B-SO_3^-; \quad (2)$$

$$R_1-\underset{\underset{\underset{\underset{\underset{SO_3^-;}{|}}{A}}{|}}{S}}{\overset{\overset{R_2}{|}}{N}}-C- \quad (3)$$

$$-C-\underset{\underset{\underset{\underset{\underset{SO_3^-;}{|}}{B}}{|}}{S}}{\overset{\overset{R_3}{|}}{N}}-R_4 \quad (4)$$

or mixtures thereof; wherein $R_1$, $R_2$, $R_3$ and $R_4$ each individually is an alkyl group having 1 to 6 carbon atoms, and wherein A and B each individually is an alkylene group having 1 to 6 carbon atoms.

The oxidation product of this invention can be used as a brightener additive in strong acid plating systems. Typically strong acid plating systems include in an aqueous solution, a strong acid such as sulfuric acid, a source of electroreducible metal such as copper sulfate, and other components. The brightener additive composition of this invention can be used in such acid plating systems at a concentration of about 0.01 to about 1,000 parts of the brightener composition per million parts of the total plating medium. Preferably the brightener additive is added at a concentration of about 0.1 to 800 parts of brightener additive per million parts of the total plating medium. More preferably, the composition of the invention can be added to the electroplating bath medium at a concentration of about 0.2 to about 750 parts of the brightener composition per million parts of the plating bath medium.

The brightener of this invention typically can be supplied in concentrate form as an aqueous solution containing the brightener additive at a concentration of 0.2 to 20 grams of brightener per liter of concentrate, a leveler additive composition at a concentration of 0.01 to 5 grams of leveler per liter of concentrate, and one or more polyalkylene oxide compounds, at a concentration of about 0.1 to 5 grams of total polyalkylene compound per liter of concentrate. The additive package typically is added to acidic metal plating baths at sufficient amounts to result in a concentration of the brightener additive in the plating medium of about 0.01 to 1,000 parts per million parts of plating medium. Most preferably for reasons of high quality plating at lowest cost, the brightener is used at a concentration of 0.01 to 100 parts of brightener per million parts of plating medium. The leveler additive can be used in the plating medium at a concentration of about 0.005 to 100 parts, preferably 0.01 to 100 parts, of leveler additive per million parts of plating medium. Preferably alkylene oxide compounds for this invention can be used in a plating medium at a concentration of about 0.01 to 500, preferably 0.05 to 250 parts per million parts of plating medium. Most preferably for reasons of effective plating with no break-in, the polyalkylene oxide surfactants selected for use in the plating bath medium preferably have a relationship between the lower molecular weight components of the surfactant and the higher molecular weight components of the surfactants such that at least 10% of the surfactant comprises a portion having a molecular weight greater than 5,700. Preferably at least 20% of the surfactant has a portion having a molecular weight greater than 5,700.

The additive concentrate can also be used to replenish the plating media during extended periods of the medium use. About 0.10 to 2 mL of the concentrate can be added to the medium per each amp-hour (0.10–2 mL $Amp^{-1}hr^{-1}$) of use.

As previously stated the acid copper plating bath additive will be prepared in a solution with a pH not greater than about 1. Either a mineral or organic acid can be employed in the peroxide oxidation. An example of a mineral acid is HCl; an example of an organic acid is p-toluenesulfonic acid.

The above described invention can be further illustrated and understood by reference to the following Examples which include a best mode.

EXAMPLE 1

Into a 250 mL beaker was placed 100 mL of 3M HCl and 0.1 grams of N,N-dimethylamino-thioxomethyl-thiopropanesulfonate, sodium salt (0.33 mmoles). 200 μL of 35% hydrogen peroxide (0.07 g, 2.0 mmoles) was added, and the mixture was stirred at room temperature for 18 hours. The reaction mixture was placed on a freeze-dryer, frozen to −50° C. with liquid nitrogen, and a vacuum applied. The pressure was maintained at or below 200 millitorr for 48 hours, after which a white solid remained. This solid was analyzed by high pressure liquid chromatography (HPLC) using the method substantially as described in Heikkila et al., U.S. Pat. No. 4,628,726, column 8, lines 5 to 35 except, that the injection volume was 50 microliters instead of 10; the solvent flow rate was 1.25 milliliters per minute instead of 1.0; and the ultraviolet light detector was adjusted to 272 nM instead of 205 nM. The chromatogram of the solid had a retention time of 1.6 minutes. A UV spectrum of the major peak indicated a UV maximum absorption at 250 nM. The commercial brightener (starting material) gave a retention time of 4.2 min using the same system. The product was also characterized by dissolving about 0.03 grams in 100 mL of water or acid. Using the method substantially as described in U.S. Pat. No. 4,628,726, a sample of this solution was injected into an HPLC with an injection loop of 50 or 100 μL, a Zorbax $R_x$ column, 25 cm×4.6 mm, and a mobile phase consisting of (phosphate buffer, pH 2.5):acetonitrile (98:2), at a flow rate of 1.25 mL/min. The product was detected at 270 nm using a variable wavelength UV detector. The column temperature was maintained at 40° C. Using this system, the chromatogram obtained had peaks of 3.0 min (9% AUC), 4.3 min (28% AUC), 6.5 min (5% AUC), 8.3 min (8% AUC), 9.9 min (5% AUC), 13.3 min (4% AUC), and 15.2 min (55% AUC).

EXAMPLE 2

Into a 250 mL round bottom flask equipped with a magnetic stirrer and thermometer was added 85 ml of deionized water, 10.0 ml of 35% HCl (3.5 grams, 0.10 moles), and 5 grams of N,N-dimethylamino-thioxomethyl-thiopropanesulfonate, sodium salt (0.016 moles) (brightener). At 0.0 minutes, hydrogen peroxide addition was started. At 30 minutes, 5.7 ml of 30% hydrogen peroxide (1.71 grams, 0.05 moles) had been added. During the addition, the temperature of the mixture rose 5° to 7° C. The solution slowly became cloudy from fine solids which formed during the addition. After stirring for 2 hours, the water was evaporated until a thick mass of solid remained. At this point 100 ml each of methanol and xylene were added, and the mixture was rotoevaporated to remove the remaining water azeotropically. A white cake was isolated from this mixture. This product was purified by dissolving it in 50 ml of methanol, filtering off the insoluble residue, and adding 100 ml of diethyl ether, at which time the product precipitated. The product was analyzed using the Zorbax $R_x$ column, and had a chromatographic profile of 4.3 min (22% AUC), 9.4 min (3% AUC), and 11.8 min (77% AUC).

EXAMPLE 3

The experiment was done as described in Example 2 except that the reaction was done in a 500 ml round bottom flask. The amount of water used was 212 ml, the amount of HCl was 25.0 ml, the amount of brightener was 12.5 grams (0.04 moles), and the amount of hydrogen peroxide was 14.25 ml (4.28 grams, 0.12 moles), diluted to 10% with water (42.75 ml total). The peroxide was fed into the reaction mixture with a peristaltic pump, which had been calibrated to deliver the entire charge of peroxide over a four-hour period. After the addition of the peroxide had been completed, the feed pump was stopped, and the reaction was allowed to stir overnight.

EXAMPLE 4

The experiment as described in Example 2 was repeated except that the HCl was replaced with an equimolar amount of p-toluenesulfonic acid.

EXAMPLE 5

The experiment as described in Example 2 was repeated except that the hydrogen peroxide was replaced with an equimolar amount of cerium (IV) sulfate.

EXAMPLE 6

The experiment as described in Example 2 was repeated except that the product was isolated from methanol/1-propanol instead of methanol/xylene, and the product was filtered to isolate it from the residual oil formed.

EXAMPLE 7

The experiment as described in Example 6 is repeated except that the reaction is carried out in an equal amount of sulfuric acid instead of in HCl.

EXAMPLE 8

The experiment as described in Example 6 is repeated except that the reaction is carried out in an equal amount of phosphoric acid instead of in HCl.

EXAMPLE 9

An acid copper plating bath (40 liter) was equipped with copper anodes, air sparge, and an additive feed system. The plating bath had the following composition:

Copper Sulfate ($CuSO_{4.5}H_2O$) 75 grams/liter
Concentrated Sulfuric Acid 200 grams/liter
chloride ion 25 ppm there was also added the luster former:

polyethylene glycol (MW=8000) 0.3 grams/liter

A stock solution of the reaction product (0.06 grams/liter) was prepared in 1M $H_2SO_4$. Normally, at this point a large dose (18 μm) of brightener is added, a dummy board is placed into the bath and the current is ramped-up to break in the bath. In this example, 350 mL of the reaction product solution and a board with plated through-holes was added to the bath, and plating at 25 ASF and an additive feed rate of 4 mL/min was started. After 25 min, the board was removed and it was bright in appearance. This board passed all solder shock tests (10 sec. at 550° F.). Next, a stainless steel panel was placed in the bath, and plating was continued at 20 ASF for about 2 hours, at which time the board was removed (it was also bright) and the deposit passed both tensile strength and % elongation tests, with results of 48,000 psi for tensile strength and 17% elongation. The plating was continued at a current density of 25 ASF, and the additive feed at 4 mL/min, for about 4 hours. At this point, the additive feed rate was lowered to 2 mL/min. Acceptable plating as measured by appearance and physical properties was obtained throughout.

What is claimed is:

1. An acid copper plating bath for producing smooth copper coatings of high brilliancy containing at least one brightener consisting of a peroxide oxidation product of a dialkylamino-thioxomethyl-thioalkane-sulfonic acid wherein each alkyl and alkane group individually contains from 1 to 6 carbon atoms and wherein the peroxide oxidation of the dialkylamino-thioxomethyl-thioalkanesulfonic acid is carried out in an acid, aqueous medium having a pH of not greater than about 1.

2. The acid copper plating bath of claim 1 wherein the acid, aqueous medium has a pH less than 1.

3. The acid copper plating bath of claim 1 wherein the acid of the acid, aqueous medium is a mineral acid.

4. The acid copper plating bath of claim 3 wherein the acid, aqueous medium contains HCl.

5. The acid copper plating bath of claim 1 wherein the acid, aqueous medium contains an organic acid.

6. The acid copper plating bath of claim 5 wherein the acid is p-toluenesulfonic acid.

7. The acid copper plating bath of claim 1 wherein each alkyl of the dialkylamino-thioxomethyl-thioalkanesulfonic acid is selected from methyl, ethyl, propyl, isopropyl, butyl, isobutyl, t-butyl, amyl, or hexyl.

8. The acid copper plating bath of claim 1 wherein the alkane of the dialkylamino-thioxomethyl-thioalkanesulfonic acid is selected from methane, ethane, propane, butane, pentane, hexane and isomers thereof.

9. The acid copper plating bath of claim 1 wherein the dialkylamino-thioxomethyl-thioalkanesulfonic acid is dimethylamino-thioxomethyl-thio-1,3-propane-sulfonic acid.

10. The acid copper plating bath of claim 1 wherein the brightener is

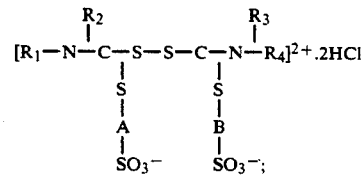

(1)

or isomers thereof; wherein $R_1$, $R_2$, $R_3$ and $R_4$ each individually is an alkyl group having 1 to 6 carbon atoms, and wherein A and B each individually is an alkylene group having 1 to 6 carbon atoms.

11. The acid copper plating bath of claim 1 containing hydrolysis products of the peroxide oxidation product of the dialkylamino-thioxomethyl-thioalkane-sulfonic acid.

12. The acid copper plating bath of claim 11 wherein the hydrolysis products of the peroxide oxidation product of a dialkylamino-thioxomethyl-thioalkane-sulfonic acid are selected from the group consisting of $R_5$—SH; $R_5$—SOH; $R_5$—$SO_2H$; $R_5SO_3H$; $R_5$—S—S—$R_6$; $R_5$—SO—S—$R_6$; and $R_5$—$SO_2$—S—$R_6$, wherein $R_5$ and $R_6$ are independently selected from the group consisting of $$-A-SO_3^-; \quad (1)$$

$$-B-SO_3^-; \quad (2)$$

$$R_1-N(R_2)-C(=S)-A-SO_3^-; \quad (3)$$

-continued $$-C(=S)-N(R_3)-B-SO_3^-; \quad (4)$$

wherein $R_1$, $R_2$, $R_3$ and $R_4$ each individually is an alkyl group having 1 to 6 carbon atoms, and wherein A and B each individually is an alkylene group having 1 to 6 carbon atoms.

13. The acid copper plating bath of claim 12 wherein the hydrolysis product of the peroxide oxidation product is $R_5$—$SO_2$—S—$R_6$, wherein $R_5$ and $R_6$ are independently selected from the group consisting of (1) —A—$SO_3$—;

(2) —B—$SO_3$—.

14. The acid copper plating bath of claim 1 wherein the dialkylamino-thioxomethyl-thioalkanesulfonic acid is present as a sulfonate salt.

15. An acid copper plating bath for producing smooth copper coatings of high brilliancy containing a brightener consisting essentially of a cerium (IV) oxidation product of a dialkylamino-thioxomethyl-thioalkanesulfonic acid wherein each alkyl and alkane group individually contains 1 to 6 carbon atoms and wherein the cerium (IV) oxidation of the dialkylamino-thioxomethyl-thioalkanesulfonic acid is carried out in an acid, aqueous medium having a pH of not more than about 1.

* * * * *